US005681035A

United States Patent [19]

Ifkovits et al.

[11] Patent Number: 5,681,035

[45] Date of Patent: Oct. 28, 1997

[54] IN-LINE BURSTER FOR INSERTING SYSTEM

[75] Inventors: Edward M. Ifkovits, New Fairfield; Eric J. Janatka, Danbury; Karel J. Janatka, Southbury, all of Conn.; Rebecca J. Pritting, Pawling, N.Y.

[73] Assignee: Pitney Bowes Inc., Stamford, Conn.

[21] Appl. No.: 712,725

[22] Filed: Sep. 12, 1996

[51] Int. Cl.[6] ..... B42C 1/10

[52] U.S. Cl. ..... 270/51; 270/52.12; 270/58.56

[58] Field of Search ..... 270/51, 52.12, 270/52.19, 52.2, 52.21, 52.22, 58.06

[56] References Cited

U.S. PATENT DOCUMENTS

| | | | |
|---|---|---|---|
| 5,104,104 | 4/1992 | Mol | 270/52.12 |
| 5,156,384 | 10/1992 | Donahue | 270/52.12 |
| 5,573,232 | 11/1996 | Ifkovits et al. | 270/51 |

*Primary Examiner*—John T. Kwon

*Attorney, Agent, or Firm*—Christopher J. Capelli; Robert H. Whisker; Melvin J. Scolnick

[57] ABSTRACT

Apparatus for inserting sheets of paper into an envelope. The apparatus includes: a first bursting module for separating a first web of paper into discrete sheets; a conveying device for conveying the discrete sheets from an upstream location to a downstream location along a feed path; a device for feeding a second web of paper having a plurality of longitudinally spaced lines of weakening oriented perpendicular to the feed path; a device for turning the second web of paper parallel to the feed path; a bursting device for bursting the second web into discrete sheets; a device for conveying the second web discrete sheets to the first web discrete sheets; a device for conveying the first web and the second web discrete sheets downstream along the feed path; and a device for inserting the first web and second web discrete sheets into an envelope.

10 Claims, 5 Drawing Sheets

IN-LINE BURSTER FOR INSERTING SYSTEM

BACKGROUND OF THE INVENTION

The instant invention relates to a method and apparatus for inserting documents into envelopes and more particularly to such method and apparatus for feeding more than one burst sheet of paper to a feed path for an inserting system.

Inserting systems are well known for collating various documents and inserting them into a waiting envelope. The documents typically include flat inserts as well as letter length documents which are then folded prior to insertion into the envelope. Inserting systems essentially consist of modules which are connected together to form a feed path so that all of the materials to be processed travel in a straight line. Certain constraints are imposed by a straight line feed path, one being that typically only a single burst sheet can be fed along the feed path for insertion to the waiting envelope. If a second burst sheet is to be fed along the feed path for envelope insertion, it has been necessary to employ a second feed path which is typically located above the primary feed path. The second burst sheet and the second feed path then must be merged with the primary feed path. Obviously, the apparatus and space needed to accomplish the merging of the two feed paths is extensive.

The instant invention thus provides a method and apparatus which allow a second burst sheel to be fed in-line to the feed path of an inserting system without the need for a second feed path.

SUMMARY OF THE INVENTION

Thus, the apparatus of the instant invention is for inserting sheets of paper into an envolope, and includes: a first bursting module for separating a first web of paper into discrete sheets; a conveying device for conveying the discrete sheets from an upstream location to a downstream location along a feed path: a device for feeding a second web of paper having a plurality of longitudinally spaced lines of weakening oriented perpendicular to the feed path; a device for turning the second web of paper parallel to the feed path; a bursting device for bursting the second web into discrete sheets; a device for conveying the second web discrete sheets to the first web discrete sheets; a device for conveying the first web and the second web discrete sheets downstream along the feed path; and a device for inserting the first web and second web discrete sheets into an envelope.

DETAILED DESCRIPTION OF THE PREFERRED EMBODIMENT

Figure 1:
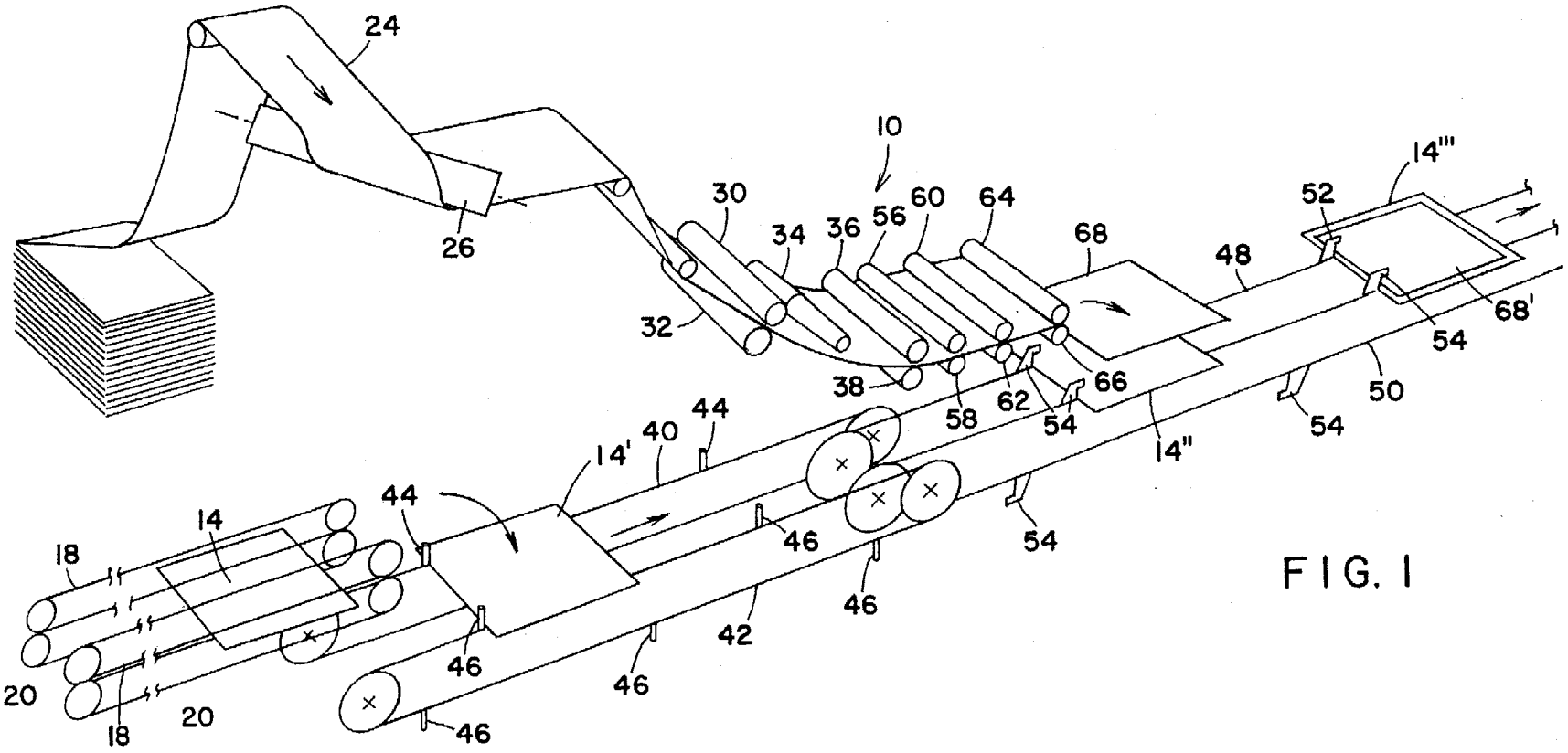
FIG. 1 is a perspective, schematic view of a portion of a dual web, in-line bursting system in accordance with the instant invention.
Figure 2:
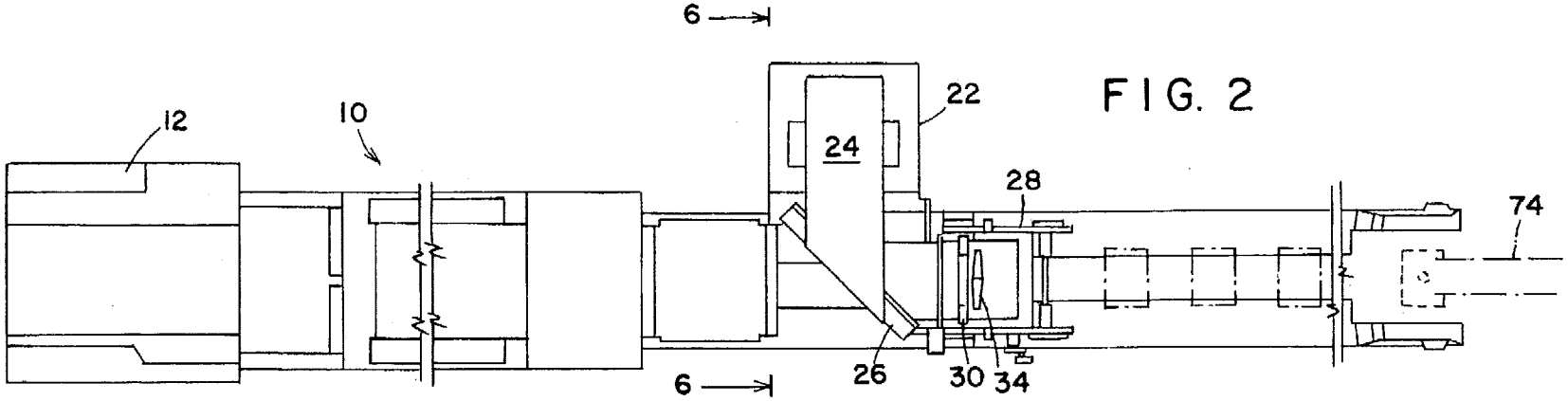
FIG. 2 is a top, plan view of a dual web, in-line bursting system in accordance with the instant invention.
Figure 3:
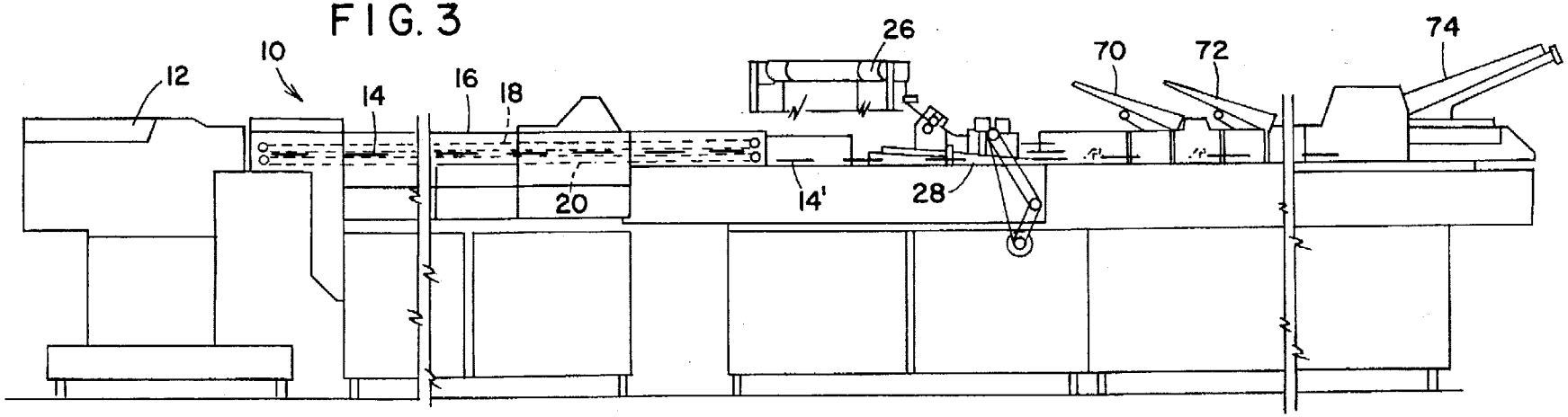
FIG. 3 is a side, elevation view of the apparatus seen in FIG. 2.

In describing the preferred embodiment of the instant invention, reference is made to the drawings wherein there is seen in FIGS. 2 and 3 an inserting system generally designated 10 which includes a conventional bursting module 12 for bursting a web of paper (not shown) fed from an upstream location into discrete sheets such as paper sheets 14 and 14' which are received from the bursting module 12 by an O-ring belt conveyor 16 having a pair of upper and lower O-ring belts 18 and 20 respectively The conveyor 16 continues to feed the discrete sheet 14 downstream in the feed path indicated by the arrows in FIGS. 2 and 3 to the position occupied by the sheet 14' (see FIG. 1 ).

Figure 4:
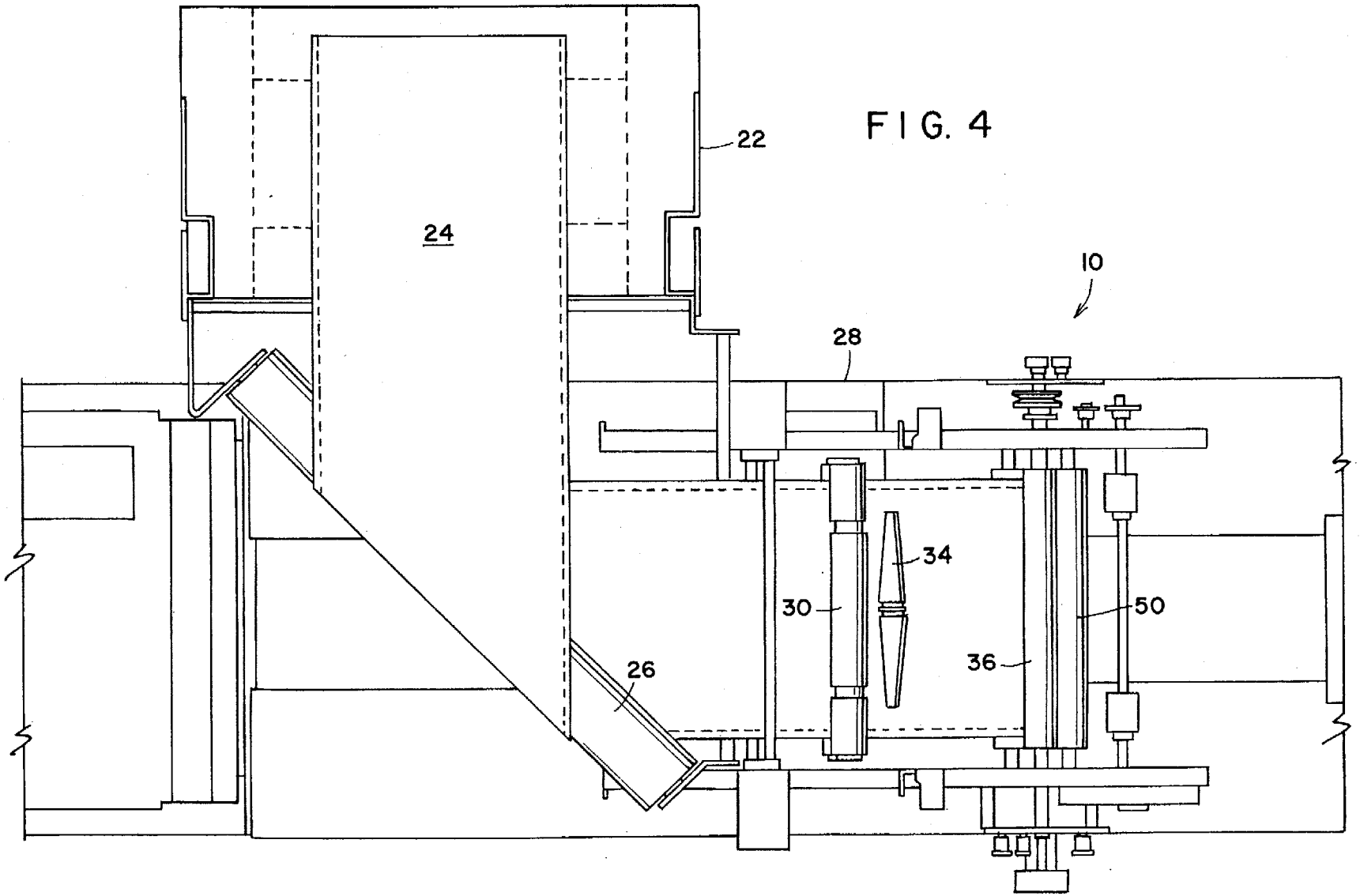
FIG. 4 is an enlarged, top, plan view of the side-mounted burster seen in FIGS. 1–3.
Figure 5:
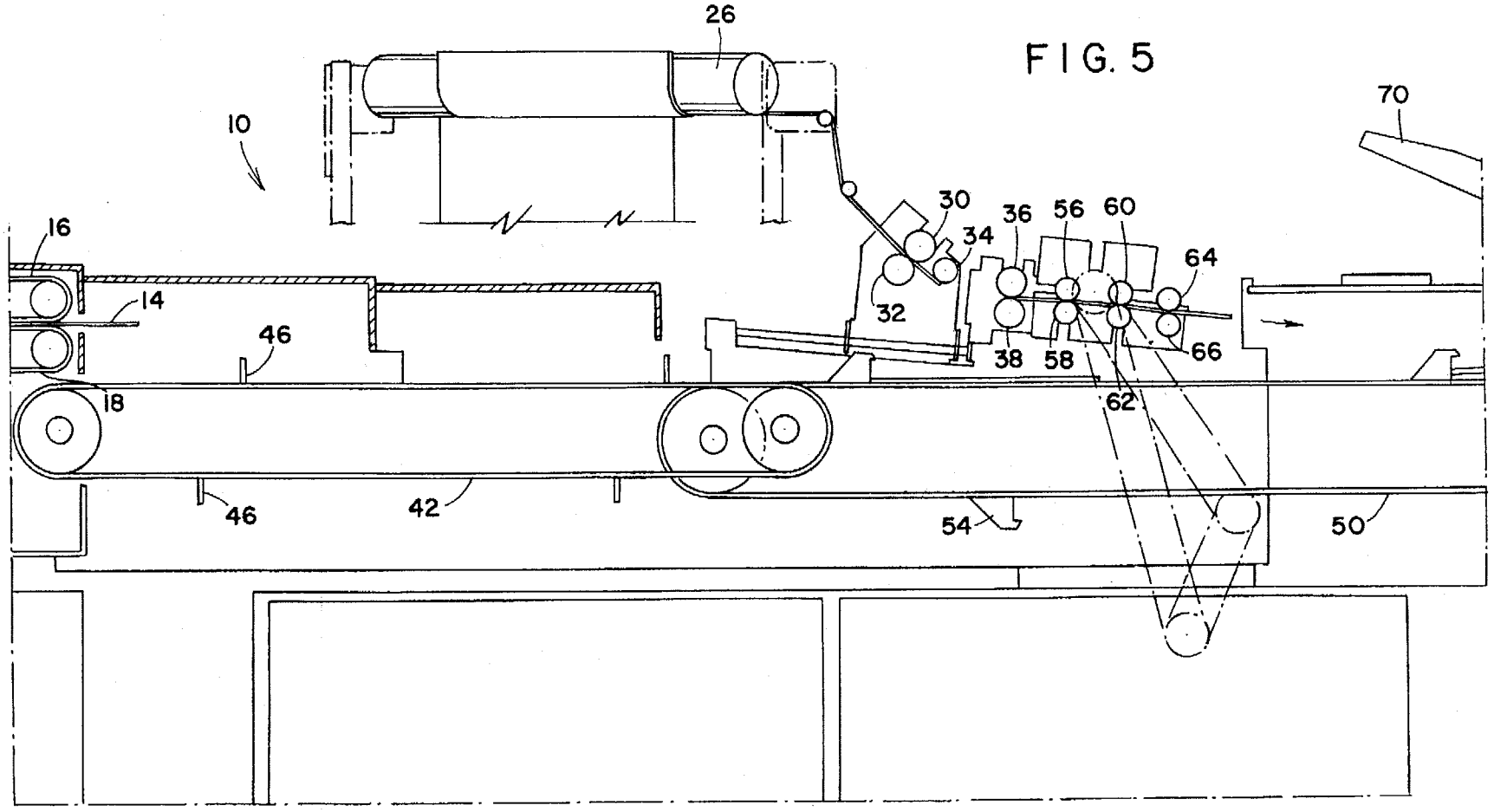
FIG. 5 is a side, elevational view of the apparatus seen in FIG. 4.
Figure 6:
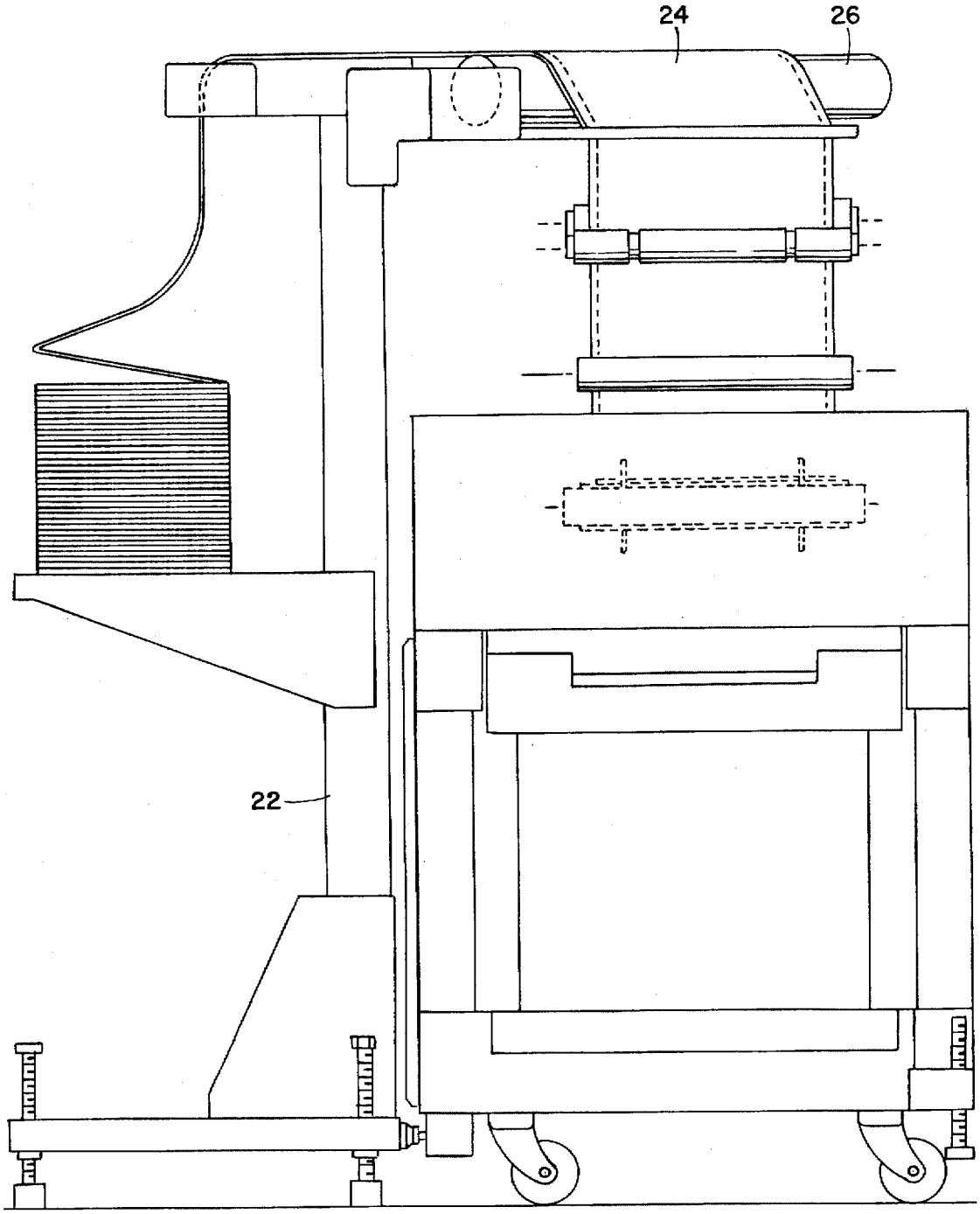
FIG. 6 is an elevational view taken on the plane indicated by the line 6—6 in FIG. 2.

Adjacent the feed path and downstream of the conveyor 16 is a web feeder 22 (see FIGS. 2 and 4) for feeding a fan-folded web of paper 24 having longitudinally spaced lines of weakening oriented perpendicular to the feed path over and around a turn bar 26 so that the paper web 24 is turned 90 degrees by the turn bar 26 in the direction of the feed path and into a second bursting module 28 which includes a pair of breaking rollers 30 and 32 (see FIG. 5), a bursting cone 34 and a pair of bursting rollers 36 and 38. Below the turn bar 26 and the second bursting module 28 are a pair of endless chains 40 and 42 having a plurality of longitudinally spaced pusher fingers 44 and 46 respectively. As seen in FIGS. 1, 3 and 5, the feed path of the pusher fingers 44 and 46 is below the feed path of the conveyor 16. Thus, the sheet 14' is conveyed by the conveyor 16 toward the chains 40 and 42 and dropped onto the chains 40 and 42 so that the pusher fingers 44 and 46 can convey the paper sheet 14' downstream toward a second pair of chains 48 and 50 having a plurality of longitudinally spaced pushers 52 and 54 respectively.

Downstream of the bursting rollers 36 and 38 are three pairs of feeding rollers 56 and 58, 60 and 62, and 64 and 66. The breaking rollers 30 and 32, the bursting cone 34 and the bursting rollers 36 and 38 function in well known manner to burst the web 24 into discrete sheets such as sheets 68 and 68'. The feeding rollers 56, 58, 60, 62, 64 and 66 then convey each discrete sheet 68, 68', etc. downstream in synchronized relationship to the chain pushers 44 and 46 and 52 and 54 so that as a discrete sheet such as sheet 14" is just arriving with its trailing edge below the feeding rollers 64 and 66 a discrete sheet such as sheet 68 descends upon the sheet 14". The pushers 52 and 54 then convey the pair of sheets, such as sheets 14'" and 68' downstream where they can be combined with insert documents from insert feeders 70 and 72 (see FIGS. 2 and 3). Finally, the entire collation of sheets and insert documents is inserted into a waiting envelope at the insertion module 74.

Although the discrete sheets 68 and 68' from the second bursting module 28 are shown as being deposited on top of the sheets 14" and 14'" from the first bursting module 12, the apparatus can be arranged so that the output from the first bursting module 12 is deposited on top of the output from the second bursting module 28.

From the foregoing description, it can be seen that two bursting modules 12 and 28 are employed with only a single feed path. Clearly, additional bursting modules could be employed alongside the feed path if desired. The use of more than one bursting module in accordance with the instant invention does not overload any of the other modules in the feed path and does not slow the throughput.

It should be understood by those skilled in the art that various modifications may be made in the present invention without departing from the spirit and scope thereof, as described in the specification and defined in the appended claims.

What is claimed is:

1. Apparatus for inserting sheets of paper into an envelope, comprising:

a first bursting module for separating a first web of paper into discrete sheets;

conveying means for conveying said discrete sheets from an upstream location to a downstream location along a feed path;

means for feeding a second web of paper having a plurality of longitudinally spaced lines of weakening oriented perpendicular to said feed path;

means for turning said second web of paper parallel to said feed path;

bursting means for bursting said second web into discrete sheets;

means for conveying said second web discrete sheets to said first web discrete sheets;

means for conveying said first web and said second web discrete sheets downstream along said feed path; and means for inserting said first web and second web discrete sheets into an envelope.

2. The apparatus of claim 1, wherein said turning means comprises a turning bar.

3. The apparatus of claim 2, wherein each of said bursting modules includes a pair of breaking rollers and a pair of bursting rollers.

4. The apparatus of claim 3, wherein each of said bursting modules additionally includes a bursting cone.

5. The apparatus of claim 4, wherein said first and second web conveying means includes pusher fingers.

6. The apparatus of claim 5, wherein said second web conveying means includes a plurality of rollers.

7. A method of inserting sheets of paper into an envelope, comprising:

bursting a first web of paper into discrete sheets;

conveying said discrete sheets from an upstream location to a downstream location along a feed path;

feeding a second web of paper having a plurality of longitudinally spaced lines of weakening oriented perpendicular to said feed path;

turning said second web of paper parallel to said feed path;

bursting said second web into discrete sheets;

conveying said second web discrete sheets to said first web discrete sheets;

conveying said first web and said second web discrete sheets downstream along said feed path; and inserting said first web and second web discrete sheets into an envelope.

8. The method of claim 7, wherein said turning is effected with a turning bar.

9. The method of claim 8, wherein said bursting is effected with a pair of breaking rollers and a pair of bursting rollers.

10. The method of claim 9, wherein said bursting is further effected with a bursting cone.

* * * * *